US008201417B1

(12) United States Patent
Lynch

(10) Patent No.: US 8,201,417 B1
(45) Date of Patent: Jun. 19, 2012

(54) JEWELRY MOUNT WITH SAFETY CATCH

(76) Inventor: Karin E. Lynch, Alexandria, VA (US)

( * ) Notice: Subject to any disclaimer, the term of this patent is extended or adjusted under 35 U.S.C. 154(b) by 0 days.

(21) Appl. No.: 12/931,040

(22) Filed: Jan. 24, 2011

Related U.S. Application Data

(62) Division of application No. 11/805,376, filed on May 24, 2007, now Pat. No. 7,918,108.

(51) Int. Cl.
*A44C 17/02* (2006.01)

(52) U.S. Cl. ..... 63/29.1; 63/30

(58) Field of Classification Search ..... None
See application file for complete search history.

(56) References Cited

U.S. PATENT DOCUMENTS

| | | | | |
|---|---|---|---|---|
| 1,160,723 | A | 11/1915 | Lander | |
| 1,864,371 | A * | 6/1932 | Prussian | 63/29.1 |
| 2,316,225 | A | 4/1943 | De Hoffmann et al. | |
| 3,088,295 | A * | 5/1963 | Haines | 63/20 |
| 3,643,467 | A | 2/1972 | Postel | |
| 3,653,227 | A | 4/1972 | Ricci | |
| 3,739,598 | A | 6/1973 | Postel | |
| 3,933,011 | A | 1/1976 | DiGilio et al. | |
| 4,374,470 | A * | 2/1983 | Isaacson | 63/29.1 |
| 4,794,766 | A | 1/1989 | Schunk et al. | |
| 4,982,581 | A | 1/1991 | Furuyama | |
| 5,077,989 | A | 1/1992 | Dillabaugh | |
| 5,133,195 | A * | 7/1992 | Appelbaum et al. | 63/29.1 |
| 5,228,317 | A | 7/1993 | Hendricks | |
| 5,353,608 | A | 10/1994 | Berkowitz | |
| 5,375,434 | A | 12/1994 | Wertheimer et al. | |
| 5,456,095 | A | 10/1995 | Tawil et al. | |
| 5,588,310 | A | 12/1996 | Lai | |
| 6,318,122 | B1 | 11/2001 | Burgard | |
| 6,484,537 | B2 * | 11/2002 | Takessian | 63/29.1 |
| 6,490,886 | B1 | 12/2002 | Steinhauer et al. | |
| 6,584,804 | B1 | 7/2003 | Freedman et al. | |
| 6,694,779 | B1 | 2/2004 | Dreger | |
| 6,715,315 | B1 | 4/2004 | Hartgrove | |
| 6,726,050 | B1 | 4/2004 | Barentine | |
| 6,729,159 | B2 | 5/2004 | Rose | |
| 6,742,359 | B1 | 6/2004 | Takessian | |
| 6,907,753 | B2 * | 6/2005 | Lieberman | 63/29.1 |
| 7,222,503 | B2 | 5/2007 | Golove | |
| 7,322,212 | B2 | 1/2008 | Golove | |
| 7,628,036 | B1 * | 12/2009 | Chang | 63/15.5 |
| 7,918,108 | B1 * | 4/2011 | Lynch et al. | 63/29.1 |
| 2009/0235690 | A1 * | 9/2009 | Stichnoth et al. | 63/29.1 |
| 2011/0132036 | A1 * | 6/2011 | Meltzer | 63/29.1 |

FOREIGN PATENT DOCUMENTS

| | | |
|---|---|---|
| DE | 40 14 179 | 11/1991 |

* cited by examiner

*Primary Examiner* — Jack W. Lavinder
(74) *Attorney, Agent, or Firm* — Patent & Trademark Services, Inc; Joseph H. McGlynn

(57) ABSTRACT

An interchangeable jewelry mounting system that allows for the attachment and detachment of gems from a jewelry setting. This system is provided with a gem mount that has a gem permanently secured to the mount. This mount contains an internal safety catch that, when engaged secures the gem mount to the jewelry setting. The jewelry setting is provided with latches that engage pins on the gem mount to ensure that the internal safety catch does not disengage prematurely.

8 Claims, 1 Drawing Sheet

JEWELRY MOUNT WITH SAFETY CATCH

This application is a Division of application Ser. No. 11/805,376, filed May 24, 2007 now U.S. Pat. No. 7,918,108.

BACKGROUND OF THE INVENTION

This invention relates, in general, to jewelry accessories, and, in particular, to jewelry accessories which allow different gems to be mounted in a single setting and which have a safety catch.

DESCRIPTION OF THE PRIOR ART

In the prior art various types of jewelry devices have been proposed. For example, U.S. Pat. No. 3,643,467 to Postel discloses a mounting head for an article of jewelry containing interchangeable ornaments.

U.S. Pat. No. 3,653,227 to Ricci discloses an interchangeable spherical gem setting and a corresponding ring provided with the setting.

U.S. Pat. No. 3,739,598 to Postel discloses a mounting head for an article of jewelry containing interchangeable ornaments and means for disengaging the ornaments.

U.S. Pat. No. 4,794,766 to Schunk et al discloses a finger ring with an interchangeable stone.

U.S. Pat. No. 5,133,195 to Applebaum et al discloses an ornamental jewelry system in which the gem can be slid in and out of a groove in a ring.

U.S. Pat. No. 5,228,317 to Hendricks discloses a gem changer having two pivotal shanks.

U.S. Pat. No. 5,353,608 to Berkowitz discloses a multi-use jewelry piece where multiple gems can be interchangeably used in one piece of jewelry as opposed to using the same gem in different pieces of jewelry.

U.S. Pat. No. 5,375,434 to Wertheimer et al discloses a removable jewelry setting with a pivoting cover that retains a gem.

U.S. Pat. No. 6,318,122 to Burgard discloses an interchangeable ornament jewelry display.

U.S. Pat. No. 6,484,537 to Takesian discloses a replaceable gem stone setting for a jewelry piece.

U.S. Pat. No. 6,490,886 to Steinhauer et al discloses an interchangeable ring which allows different gems to be used on the same ring.

U.S. Pat. No. 6,584,804 to Freedman et al discloses a secure display setting for a gemstone.

U.S. Pat. No. 6,694,779 to Dreger discloses a napkin ring with an interchangeable ornament which uses magnets to hold the ornament.

U.S. Pat. No. 6,715,315 to Hargrove discloses jewelry articles having magnetic elements and interchangeable settings.

U.S. Pat. No. 6,729,159 to Rose discloses an interchangeable jewelry system for holding different gems in a setting.

U.S. Pat. No. 6,907,753 to Lieberman discloses an interchangeable jewelry system for holding different gems in a setting.

German Patent No. DE 40 14 179 to Sauter discloses a setting for a gem.

Generally, a gem is fixed into a single piece of jewelry. The gem and the jewelry can only be used as a combined unit and only worn on one part of the body. While removable gems are known in the prior art, the means of attaching the gem to the setting has not been satisfactory. Many times the attaching means is difficult to engage and disengage especially in smaller sized jewelry such as women's rings. Another disadvantage is that the attaching means can be uncomfortable if it is adjacent the user's body, such as when used in a ring. Another disadvantage is the attaching means can be complicated and, therefore, costly. Also, the attaching means does not have a safety catch for doubly insuring the safety of the gem. The present invention is designed to overcome the drawbacks of the prior art devices.

SUMMARY OF THE INVENTION

The present invention is directed to a gem mount with prongs attached to the mount that cooperate with clasps on a jewelry setting to secure different gems into the jewelry setting. A safety catch is provided that is insurance against loss of the gem.

It is an object of the present invention to provide a new and improved jewelry accessory.

It is an object of the present invention to provide a new and improved jewelry accessory which allows different gems to be secured within a setting.

It is an object of the present invention to provide a new and improved jewelry accessory which has a safety clasp to insure against loss of the gem.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
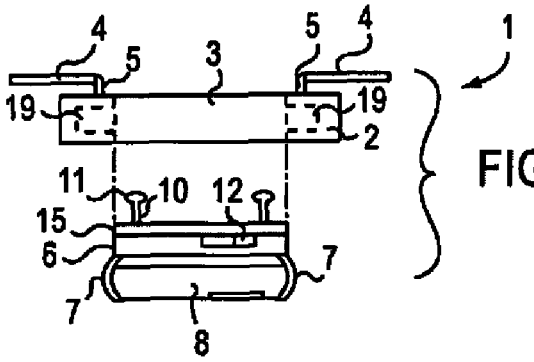
FIG. 1 is an exploded side view of the jewelry mount of the present invention and a pendant to which the mount is going to be secured.

Referring now to the drawings in greater detail, FIG. 1 shows an exploded view of the jewelry mount system 1 of the present invention showing a gem mount 6, 9, 15 which holds a gem 8. The gem 8 is secured to the gem mount by means of conventional prongs 7. The gem mount 6, 9, 15 is shown beneath a pendant 2 in which the gem mount will be secured. The pendant 2 has an aperture 3 which will allow the gem mount 6, 9, 15 and the attached gem 8 to pass through the aperture 3. The prongs 7 will stick out away from the gem 8 so they will engage the surface of the pendant surrounding the aperture 3 and prevent the gem mount 6, 9, 15 from passing completely through the aperture 3. It should be noted that even though the invention is described as being used with a pendant it is not limited to just this use. The invention can be used with any type of jewelry such as, but not limited to, pins, rings, slides, ear rings, scarf clips, bracelets, men's tie tacks, stick pins, cuff links, etc. Also, the gem or stone 8 is shown as circular, however, other shapes could be used without departing from the scope of the invention.

Figure 2:
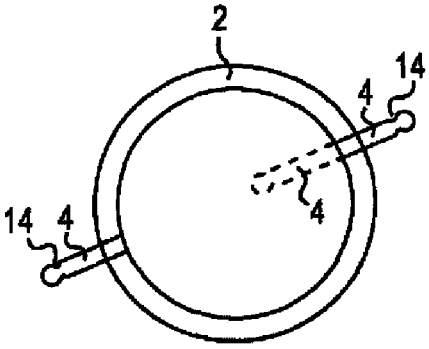
FIG. 2 is a bottom view of the pendant used with the present invention.

As shown in FIGS. 1 and 2, the pendant 2 (as seen in FIG. 1) has latches 4 pivotally secured at 5 to the surface of the pendant. Any conventional hinges can be used for this purpose. Also, the pendant has a central aperture for receiving the gem mount 6, 9, 15 and the attached gem 8. There are slots 19 positioned around the inner circumference of the central aperture 3 for a reason to be explained below.

The prongs 7 are conventional jewelry prongs that will secure a gem 8 to the surface of the gem mount 6, 9, 15. Since the prongs 7 are conventional no further description is necessary.

The latches 4 are pivoted so they can be moved from a first position shown in solid lines in FIG. 2 to a second position shown in dotted lines in FIG. 2. It should be known that only one of the latches 4 is shown rotated into the second position for clarity. In actual use both of the latches 4 will be rotated into the second position in order to secure the gem mount 6, 9, 15 to the pendant 2. Also, it should be noted that the two latches 4 are merely shown for illustrational purposes. At least one latch could be used or more than two latches could be used without departing from the scope of the invention. The latches 4 have a constricted area 14 for a purpose to be explained below.

Figure 3:
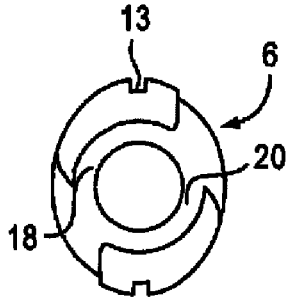
FIG. 3 is a top view of the first one of the components of the jewelry mount of the present invention.
Figure 4:
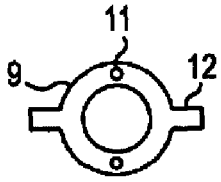
FIG. 4 is a top view of a second one of the components of the jewelry mount of the present invention.
Figure 5:
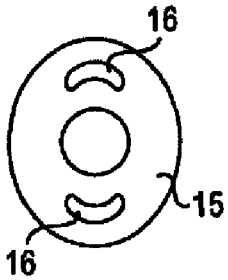
FIG. 5 is a top view of a third one of the components of the jewelry mount of the present invention.
Figure 6:
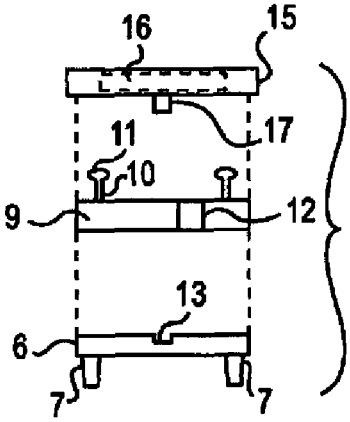
FIG. 6 is an exploded view of the three components that make up the jewelry mount of the present invention.
Figure 7:
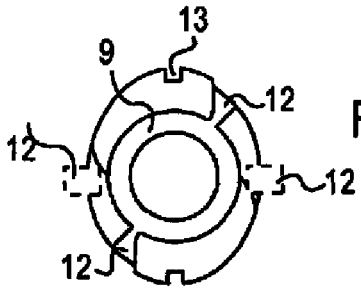
FIG. 7 is a top view of the second component of the jewelry mount of the present invention overlying the first one of the components of the jewelry mount of the present invention.

FIG. 3 shows the first of three components that make up the gem mount of the present invention. The first component 6 is generally oval or elliptical in shape. The second component 9 is generally circular in shape and is shown in FIG. 4, and the third component 15 is similar in shape to component 6, and is shown in FIG. 5. The first component 6 has a first channel 18 and a second channel 20 which will receive the catches 12 formed on the sides of the second component 9 when the second component is placed on the first component 6, as shown in FIG. 7. The second component 9 has at least one pin 10 with an enlarged head 11 that protrudes up from the surface of component 9. The third component 15 (shown in FIG. 5) has a slot 16 for each headed pin 10. The slots 16 allow the pins 10 to rotate when the second component 9 is rotated with respect to the first component, as will be explained in more detail below. The third component 15 has pegs 17 (shown in FIG. 6). The pegs 17 engage the notches 13 in the first component 6 which will secure the third component 15 to the first component 6. Since the second component 9 is sandwiched between the first and third components (as shown in FIG. 6) the pegs 17 and notches 13 will secure all three components together. The first and third component can be secured together in any conventional manner such as, but not limited to, friction, soldering, welding and adhesives. The specific manner chosen is not critical as long as component 9 is allowed to rotate with respect to component 6 with the pins protruding through the slots in component 15.

The dimension of the head 11 on pin 10 is larger than the constricted area 14 on the pivotable latches 4. However, since the latch is made from a slightly resilient material, the enlarged portion will be able to expand enough to snap over the head 11. Once the latch passes over the head 11 it will snap back beneath the head 11 and secure the latch 4 (and the gem mount 6 and the gem 8) to the pendant 2.

In order to use the present invention, a user would place the gem mount with the gem 8 attached beneath the pendant 2 as shown in FIG. 1. At this point in time the latches 4 will be in the first position shown in FIG. 1 and in the solid line position in FIG. 2, and the catches 12 will be in the solid line position shown in FIG. 7. The gem mount 6, 9, 15 would then be moved up and into the central aperture 3 of the pendant 2. When the prongs 7 engage the surface of the pendant, thereby preventing further upward movement of the gem mount 6, 9, 15, the user would slide the headed pins 10 thereby rotating component 9 with respect to components 6, 15. This would move the catches 12 from the concealed or first position, shown in solid lines in FIG. 7, to the second or protruding position shown by dotted lines in FIG. 7.

Since components 6, 15 is oval and component 9 is circular, the rotation of 9 with respect to 6, 15 will move the catches from a concealed position (when the catches are adjacent the largest dimension of the oval shape of 6) to an protruding position (when the catches are adjacent the smallest dimension of the oval shape of 6, 15). This rotation of component 9 will allow the catches to enter the slots 19 on the inner circumference of aperture 3 in the pendant 2. When the catches enter the slots, the gem mount 6, 9, 15 will be secured to the pendant.

In order to make certain that component 9 can not accidentally rotate with respect to components 6, 15, thereby separating the gem mount from the pendant 2, the latches 4 are rotated from the first position, shown in solid lines in FIG. 2, to the second position, shown in dotted lines in FIG. 2. When the latches 4 reach the second position, the constricted portion 14 will be aligned with the enlarged heads 11 on the pins 10. By pushing down on the latches 4 the constricted portion 14 will expand, due to the relatively resilient material the latch is made from, and the latch 4 will snap over and be held in place by the enlarged head 11. This will ensure against accidental loss of the gem 8.

If the user wants a different gem in the pendant, she merely has to unsnap the latches 4 from the pins 10 and rotate the pins 10 from the second position to the first position and remove the first gem mount 6, 9, 15. Then, a new mount with a different gem will be secured to the ring by inserting the new gem mount into aperture 3, rotating the pins 10 from the first position to the second position, and securing the latches 4.

By using the mounting system of the present invention, it is not necessary to have a large number of pendants, but rather one pendant can be fitted with different gems and appear to be a number of different pendants. Another use is to provide other articles of jewelry with the mounting system and then a single gem can be transferred from a pendant, for example, to a ring or other piece of jewelry. In this manner a single gem can be used in a variety of jewelry.

Although the Jewelry Mount with Safety Catch and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A system for retaining a gem mount within a jewelry setting wherein said gem mount can be interchangeably set in said jewelry setting, said system comprises:

a removable portion comprising a gem mount, said gem mount comprises three components, a first of said three components having a channel in a top surface, and a second of said three components having at least one catch movable in said channel, and a third of said three components has means for securing said first of said three components to said third of said three components, and wherein said jewelry setting has means for receiving said at least one catch on said second of said three components, and wherein said means for receiving said at least one catch on said second of said three components comprises at least one slot, and wherein said at least one slot is positioned within an inner periphery of an aperture in said jewelry setting.

2. A system for retaining a gem mount within a jewelry setting wherein said gem mount can be interchangeably set in said jewelry setting, said system comprises:

a removable portion comprising a gem mount, said gem mount comprises three components, a first of said three components having a channel in a top surface, and a second of said three components having at least one catch movable in said channel, and a third of said three components has means for securing said first of said three components to said third of said three components, and wherein said second of said three components has an upper surface and a lower surface, and said upper surface of said second of said three components has a plurality of pins projecting therefrom, and said third of said three components has means for receiving said plurality of pins.

3. The system for retaining a gem mount within a jewelry setting as claimed in claim 2, wherein said second of said three components is movable with respect to said first and third of said three components.

4. The system for retaining a gem mount within a jewelry setting as claimed in claim 2, wherein said jewelry setting has means for receiving said at least one catch on said second of said three components.

5. The system for retaining a gem mount within a jewelry setting as claimed in claim 4, wherein said means for receiving said at least one catch on said second of said three components comprises at least one slot.

6. A system for retaining a gem mount within a jewelry setting wherein said gem mount can be interchangeably set in said jewelry setting, said system comprises:

a removable portion comprising a gem mount, said gem mount comprises three components, a first of said three components having a channel in a top surface, and a second of said three components having at least one catch movable in said channel, and a third of said three components has means for securing said first of said three components to said third of said three components, and wherein said jewelry setting has a plurality of latches adjacent an aperture in said jewelry setting, said latches cooperate with a plurality of pins on said second of said three components for removably securing said gem mount to said jewelry setting.

7. The system for retaining a gem mount within a jewelry setting as claimed in claim 6, wherein each of said plurality of latches have an aperture, each said aperture having a dimension, and each of said plurality of pins have a head, each said head has a second dimension, and said first dimension is smaller than said second dimension.

8. The system for retaining a gem mount within a jewelry setting as claimed in claim 6, wherein said jewelry setting has a top surface and a bottom surface, when said gem mount is positioned in said jewelry setting said gem is adjacent said top surface and remote from said bottom surface, and wherein each of said plurality of latches is moveable from a first position to a second position, and when in said first position each of said plurality of latches is remote from said aperture in said jewelry setting, and when in said second position each of said plurality of latches overlies said aperture in said jewelry setting.

* * * * *